US011629928B1

(12) United States Patent
Kempf et al.

(10) Patent No.: US 11,629,928 B1
(45) **Date of Patent: *Apr. 18, 2023**

(54) CRANKING MECHANISM

(71) Applicant: Archery Innovators, LLC, Tiffin, IA (US)

(72) Inventors: James J. Kempf, Coralville, IA (US); Rex E. Isenhower, Stanwood, IA (US)

(73) Assignee: ARCHERY INNOUATORS, LLC, Tiffin, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/750,479

(22) Filed: May 23, 2022

Related U.S. Application Data

(62) Division of application No. 17/216,744, filed on Mar. 30, 2021, now Pat. No. 11,346,632.

(51) Int. Cl.
*F41B 5/12* (2006.01)
*F41B 5/14* (2006.01)

(52) U.S. Cl.
CPC ..... *F41B 5/12* (2013.01); *F41B 5/1449* (2013.01); *F41B 5/1469* (2013.01)

(58) Field of Classification Search
CPC ..... F41B 5/12
See application file for complete search history.

(56) References Cited

U.S. PATENT DOCUMENTS

| | | | | |
|---|---|---|---|---|
| 8,453,631 | B1 * | 6/2013 | Kronengold | F41A 19/12 124/90 |
| 9,404,706 | B2 * | 8/2016 | Khoshnood | F41B 5/123 |
| 9,719,749 | B1 * | 8/2017 | Prior | F41B 3/005 |
| 10,295,299 | B2 * | 5/2019 | Vergara | F41B 5/1469 |
| 10,421,637 | B1 * | 9/2019 | Huang | F41B 5/123 |
| 10,900,738 | B1 * | 1/2021 | Hensel | F41B 5/123 |
| 11,067,357 | B1 * | 7/2021 | Chu | F41B 5/1449 |
| 11,346,632 | B1 * | 5/2022 | Kempf | F41B 5/12 |

* cited by examiner

*Primary Examiner* — John A Ricci
(74) *Attorney, Agent, or Firm* — Donald J. Ersler

(57) ABSTRACT

A cranking mechanism preferably includes a planetary gear, a drive shaft, a one way bearing, a clutch assembly, and at least one drive unit. The clutch preferably includes a clutch pressure plate, a flywheel, friction surfaces and at least one friction plate. Each drive unit includes a carrier, a spool and a flywheel. The one way bearing and the clutch assembly are axial on the drive shaft. A pressure locking nut is threaded on to a threaded end of the crank shaft to exert pressure on the clutch assembly. The sun gear is fixed on the drive shaft. The at least one drive unit is axial with the drive shaft, and fixed with the carrier of the planetary gear set. The pressure locking nut is tightened against the clutch assembly to frictionally engage the drive shaft with the at least one drive unit.

15 Claims, 14 Drawing Sheets

CRANKING MECHANISM

CROSS-REFERENCES TO RELATED APPLICATIONS

This is a divisional patent application, which takes priority from patent application Ser. No. 17/216,744, filed on Mar. 30, 2021.

BACKGROUND OF THE INVENTION

Field of the Invention

The present invention relates generally to a cranking mechanism, which utilizes a planetary gear set for ease of use. The present invention may also use a one way bearing to lock rotation of a reel. The present invention may utilize a clutch to control rotation of a spool.

Discussion of the Prior Art

Cranking devices typically use a ratchet mechanism to lock tension on a line, string or rope. More recently the use of a clutch and a one-way bearing on a direct-drive cocking mechanism was introduced on an AXE 400 crossbow. This device allowed for the silent cocking and un-cocking of a crossbow by the user, however due to this device being direct drive, it was very difficult for the user to cock the crossbow. As the stored energy increased in the limbs, it was increasingly difficult to wind the cranking mechanism. However, it appears that the prior art does not teach or suggest a cranking mechanism which utilizes a planetary gear set, coupled with a spool, to cock a crossbow. Further, it does not teach the use of a one way bearing and or a clutch, coupled with the planetary gearbox to cock a crossbow.

Accordingly, there is a clearly felt need in the art for a cranking mechanism, which utilizes a planetary gear set coupled with a spool, and may be used with a one-way bearing and use of a clutch mechanism to control rotation of a spool. The use of a planetary gear set provides added mechanical advantage for the user, requiring much less effort to cock the crossbow, or alternatively, allowing for much higher poundage limbs while still having the ability to cock the crossbow.

SUMMARY OF THE INVENTION

The present invention provides a cranking mechanism, which utilizes a planetary gear set coupled with a drive unit to cock a crossbow. In addition, the use of a one-way bearing and clutch assembly may control the rotation of the drive unit used to wind (take-up) and unwind (pay out) an elongated connecting device. Functional properties of a planetary gear set are well known. A planetary gear set includes a sun gear, ring gear, planet gears, and a carrier. The carrier has axles radially positioned that carry the planet gears.

Functional properties of a crank mechanism for the winding and unwinding of the elongated connecting device such as a rope, chord or the like device for pulling a secondary object from a first position to a second position. For the disclosed embodiment, we will disclose based on the following:

A one-way bearing is retained in a first cranking boss extending from a first side of a stock. The sun gear is axial with the drive shaft and fixed to the drive shaft. An outer diameter of a ring gear is retained stationary in a second cranking boss to prevent rotation thereof. The second cranking boss extends from a second side of the stock. The ring gear is axial with the drive shaft and sun gear. Planet gears are radially retained on a carrier such that when the sun gear rotates in a first direction, the planet gears and the carrier rotate an opposite or second direction. In this arrangement, the planetary gear set allows for a lower input of force on the drive shaft and sun gear to create a higher output of force on the carrier. For the disclosed embodiment, the carrier may be one of coupled with the spool, or integrated with the spool. A clutch assembly may be coupled with the planetary gear assembly to control the rotation of a spool. The cranking mechanism preferably includes a drive shaft, a one way bearing, a clutch assembly, and a planetary gear set coupled with at least one drive unit and with the drive shaft. The drive shaft includes a first driven end having threads, a length, a diameter, a clutch disc engagement portion, a clutch housing portion and second end fixed with a sun gear. A crank handle may be engaged with a locking pressure nut on the driven end. The one-way bearing is pressed in to a second cranking boss extending from a second side of the stock, and radially fixed with the second crank boss to prevent unwanted rotation of the one way bearing.

The clutch assembly is axial with the drive shaft and one-way bearing, and preferably includes a clutch pressure plate having a friction surface, at least one friction plate, and a flywheel having a friction surface. The flywheel may be fixed to the first side of the spool, or preferably integrated with the spool, wherein the friction surface is adjacent the friction plate. The drive unit includes, which is sized to receive the drive shaft. The drive unit includes the carrier. The carrier includes a second side with pins extending therefrom, which are sized to receive the planet gears. The second side of the carrier acts as a portion of the planetary gear set. The drive unit may be retained by at least one radial bearing for proper axial alignment with the drive shaft and the planetary gear set. The drive unit includes a winding diameter, which is sized for the winding and unwinding of the elongated connecting device to couple the drive unit with a trigger housing or a sled designed to pull a bow string.

A sun gear is axially fixed to a second end of the drive shaft, which is driven by the crank handle on a first end. Axial to the drive shaft is a thrust bearing, which is located between the sun gear and the second side of the spool. The drive unit is axial to the drive shaft, and rotates about the drive shaft. The second side of the drive unit is the carrier for the planet gears. The ring gear of the planetary gear set is stationary and is radial to the drive shaft.

The bowstring-drawing means is engaged with a bowstring when the bowstring is in the un-cocked or at-rest position. As the crank handle is rotated a first direction, a pressure locking nut is tightened to the pressure plate, drawing the drive shaft and all associated parts with it towards the locking pressure nut, where the frictional forces occur between the first and second friction surfaces on the friction plate. The drive shaft is rotated in a first direction, causing rotation of the sun gear in a first direction, which in turn causes rotation of the planet gears, rotating the spool/flywheel in an opposite direction of the pressure plate. Frictional forces of the spool/flywheel and the friction disc cause the clutch assembly to "seize", due to the first pressure surface rotating in an opposite direction of the second pressure surface, tightening on the friction plate. The sun gear turns the planet gears, the planet gears turn the carrier (spool) to wind the elongated connecting device.

Stored energy in the bow limbs of the crossbow bias the elongated connecting device to pay out, or pull away from the spool. The drive unit and the planetary gear assembly bias the drive shaft and clutch assembly to a lock direction of the one-way bearing and pressure locking nut, such that when the crank handle is not rotated, the stored energy forces the drive unit in the direction of pay-out, however the clutch assembly again seizes and the elongated connecting device will not pay out.

Rotation of the crank handle rotated in a second direction, loosens the pressure locking nut from the pressure plate, and the stored energy causes the rotation of the drive unit in the first direction, creating counter-rotational forces throughout the assembly de-compressing the friction surfaces on the friction plate, wherein the drive unit is allowed to rotate and pays out the elongated connecting device until the crank handle is no longer rotated the second direction. The rotation of the crank handle allows the slippage of the clutch assembly just enough as to allow the drive unit to pay out the elongated connecting device. As soon as the crank handle stops rotating, the stored energy continues to bias the elongated connecting device to force the drive unit and all associated components to rotate against the one-way bearing and the pressure locking nut, automatically tightening the pressure locking nut against the pressure plate, again seizing the clutch assembly.

The one way bearing prevents the clutch housing from reversing direction, eliminating the binding forces of the friction, and unwinding the elongated connecting device.

The added feature of the disclosed invention being integrated with the stock and or frame allows for a more compact, easier to manufacture crossbow cranking device. Further, the use of at least one drive unit coupled to the elongated connecting device simplifies design, uses fewer parts, and is easier to manufacture.

Accordingly, it is an object of the present invention to provide a cranking mechanism, which utilizes a one way bearing to prevent rotation of a spool. It is an object of the invention to provide a cranking mechanism incorporated with the stock and or frame providing at least one drive unit coupled to the elongated connecting device to cock a crossbow. It is a final object of this invention to provide a mechanical advantage to the user by the incorporation of a planetary gear set.

These and additional objects, advantages, features and benefits of the present invention will become apparent from the following specification.

DETAILED DESCRIPTION OF THE PREFERRED EMBODIMENTS

Figure 1:
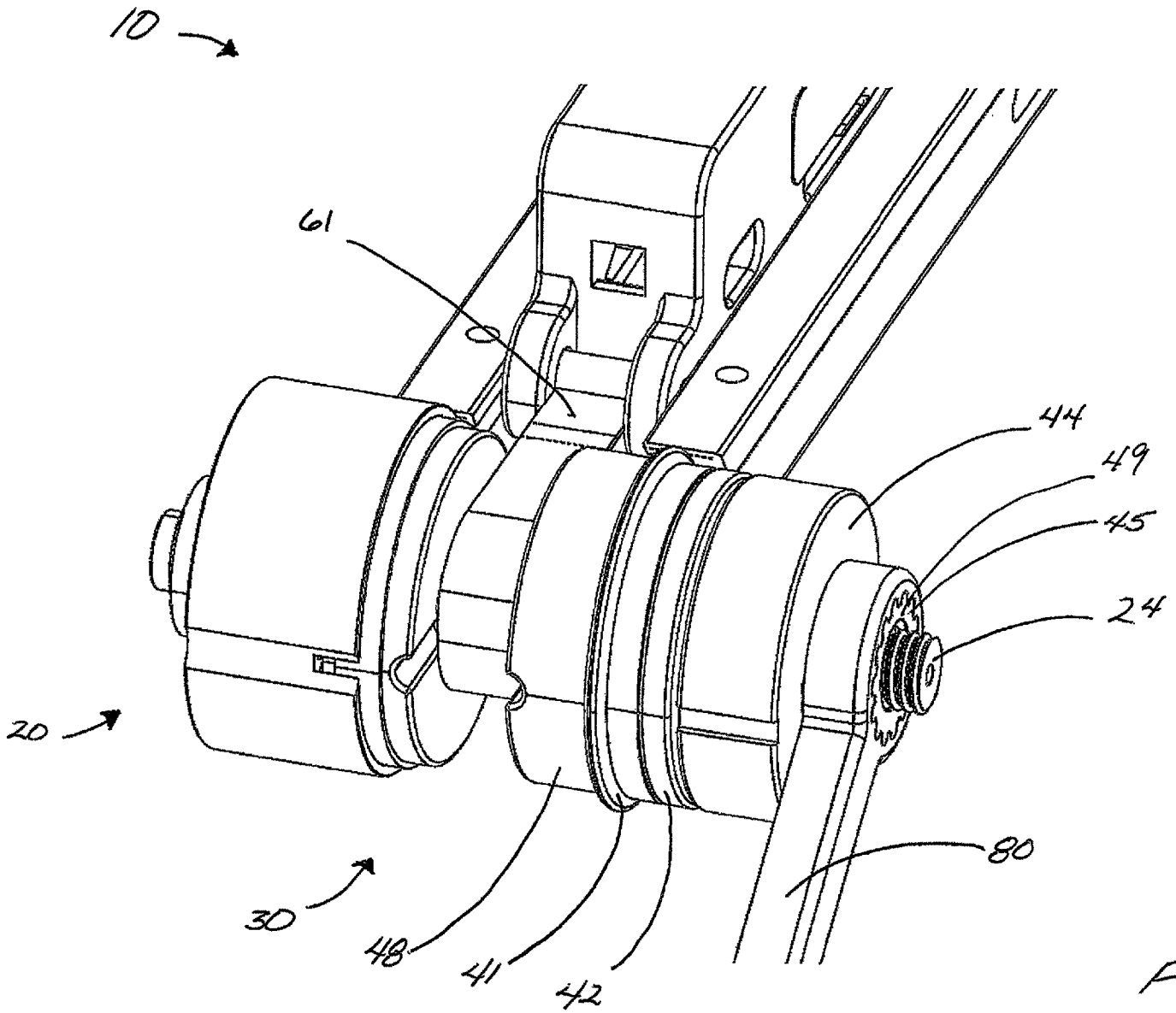
FIG. 1 is a partial rear perspective view of a cranking mechanism in accordance with the present invention.
Figure 1A:
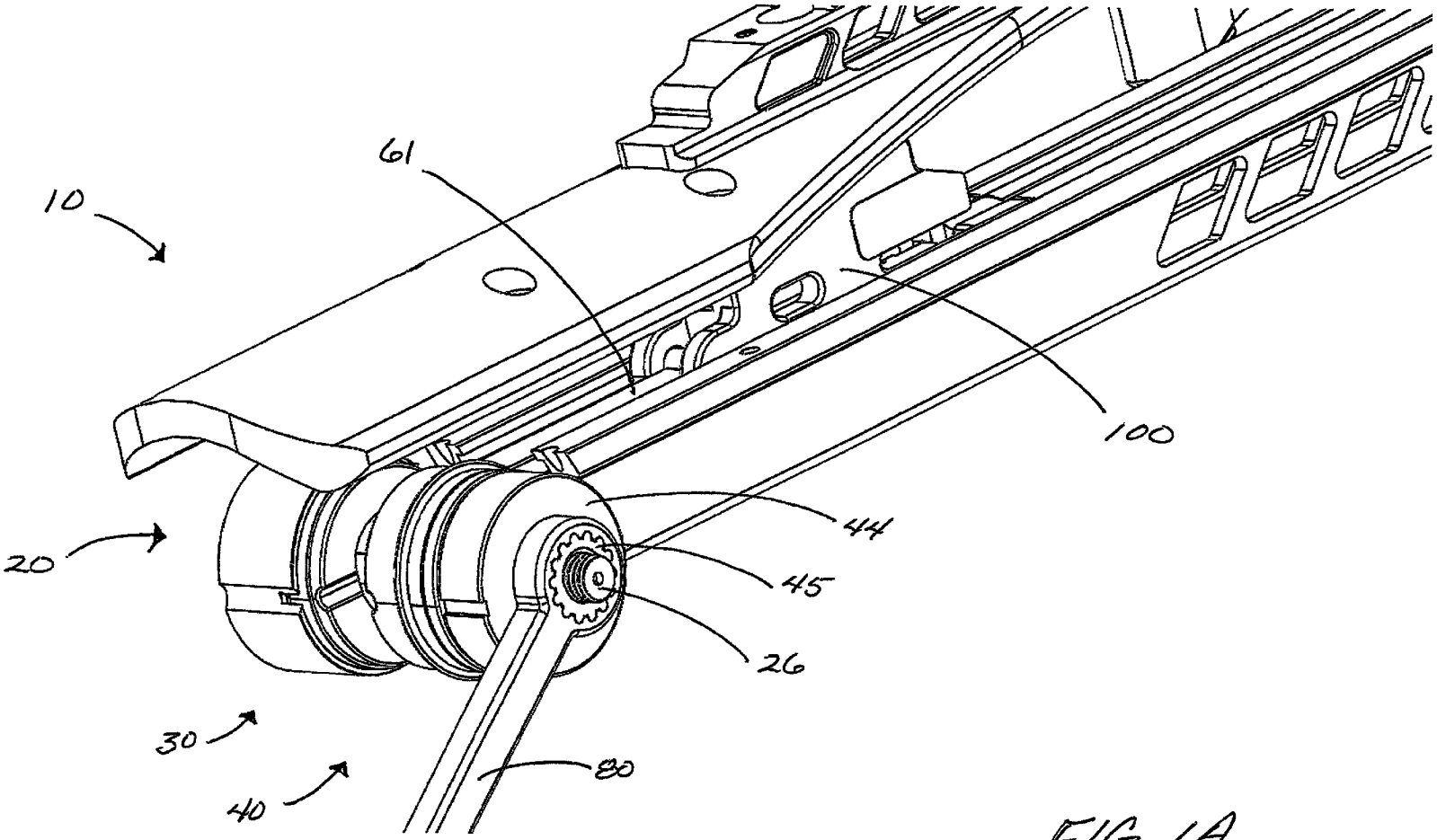
FIG. 1A is a partial side perspective view of a cranking mechanism in accordance with the present invention.

With reference now to the drawings, and particularly to FIG. 1, there is shown a partial perspective view of a cranking mechanism 10. The cranking mechanism preferably includes a planetary gearbox assembly 20, a drive axle 24, a clutch assembly 40, a drive unit 30, and an elongated connecting device 61.

Figure 4:
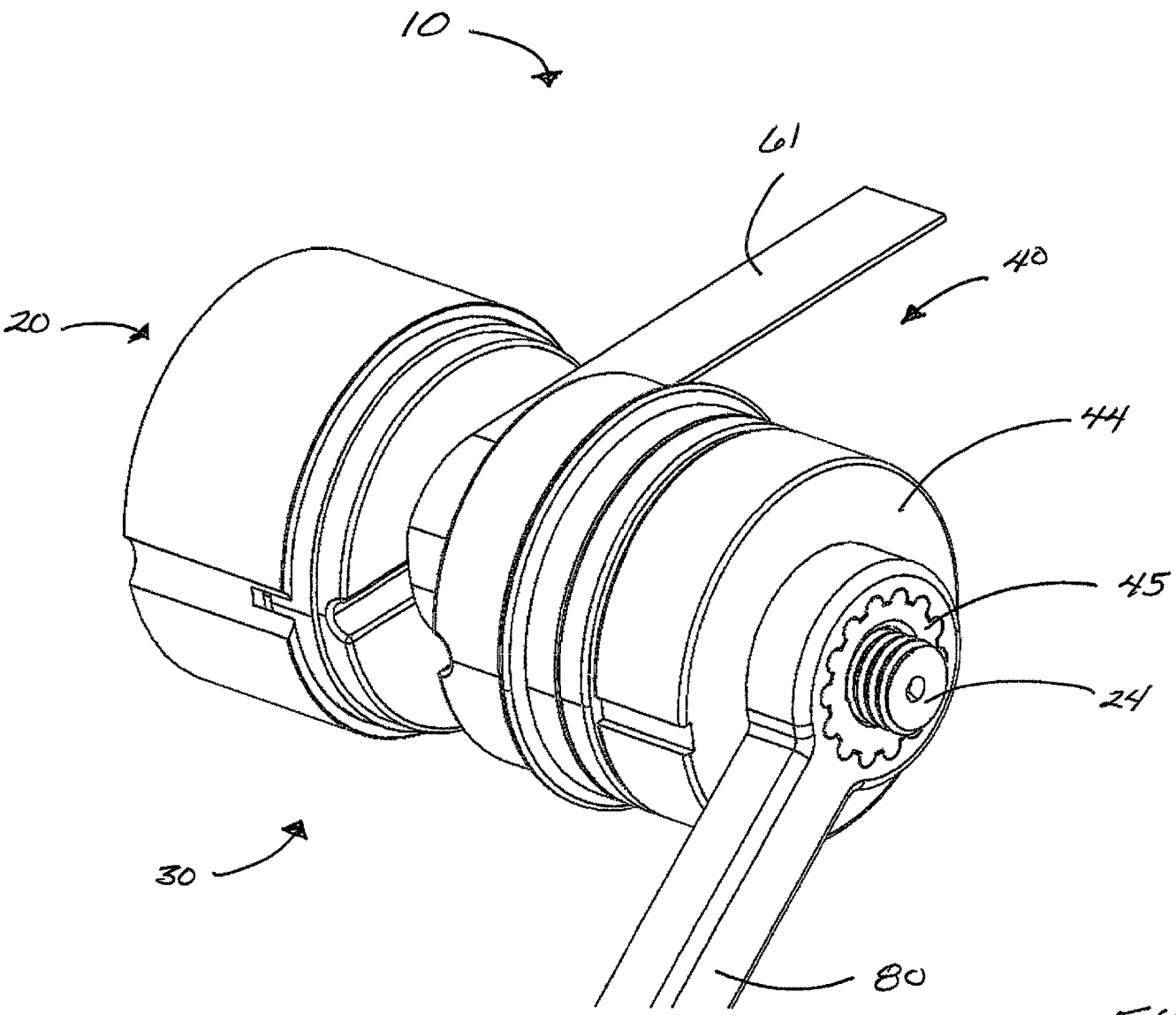
FIG. 4 is a perspective view of an assembled cranking mechanism of in accordance with the present invention.
Figure 4A:
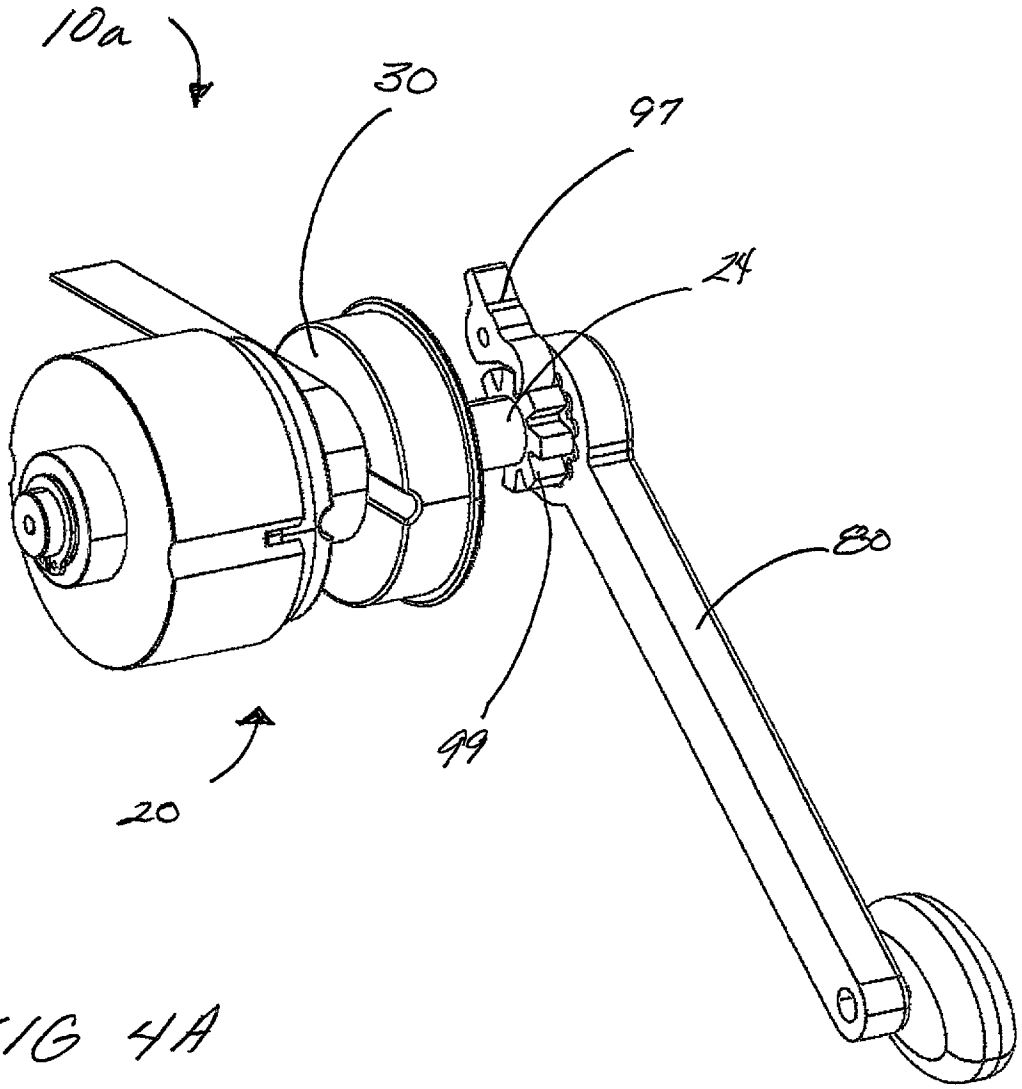
FIG. 4A is a perspective view of an assembled cranking mechanism with an anti-reverse lever in accordance with the present invention.

With reference to FIG. 4A, the cranking mechanism 10*a* includes a planetary gear assembly 20, a drive unit 30, the elongated connecting device 61, a crank handle 80, an anti-reverse lever 97 and a ratchet gear 99. The ratchet gear 99 is attached to the drive shaft 24, such that the ratchet gear 99 does not rotate relative to the drive shaft 24. The anti-reverse lever 97 and the ratchet gear 99 only allow the drive shaft 24 to rotate in one direction, unless the anti-rotation lever 97 is released from the ratchet gear 99. The crank handle 80 any suitable drive device.

Figure 4B:
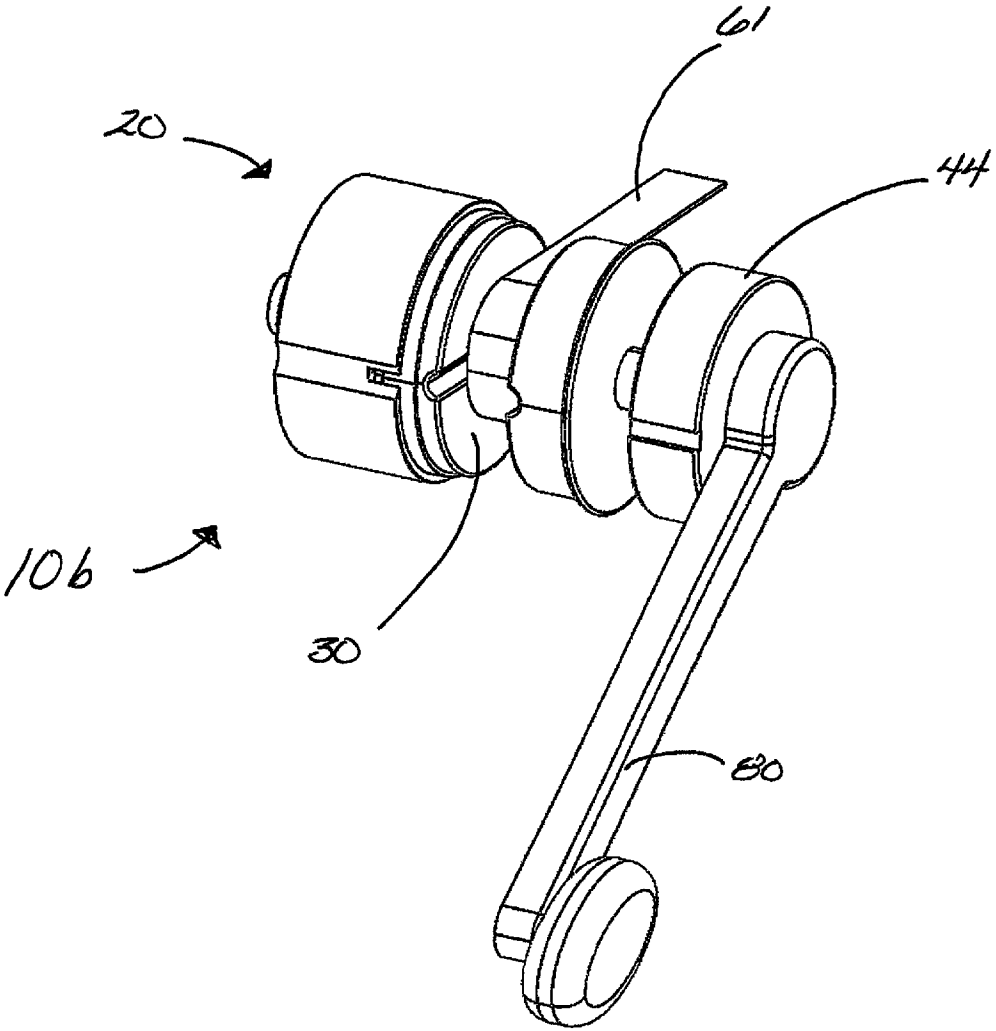
FIG. 4B is a perspective view of an assembled cranking mechanism of with a one-way bearing in accordance with the present invention.

With reference to FIG. 4B, the cranking mechanism 10*b* includes a planetary gear assembly 20, a drive unit 30, an elongated connecting device 61, a crank handle 80, and a one-way bearing 44.

Figure 2:
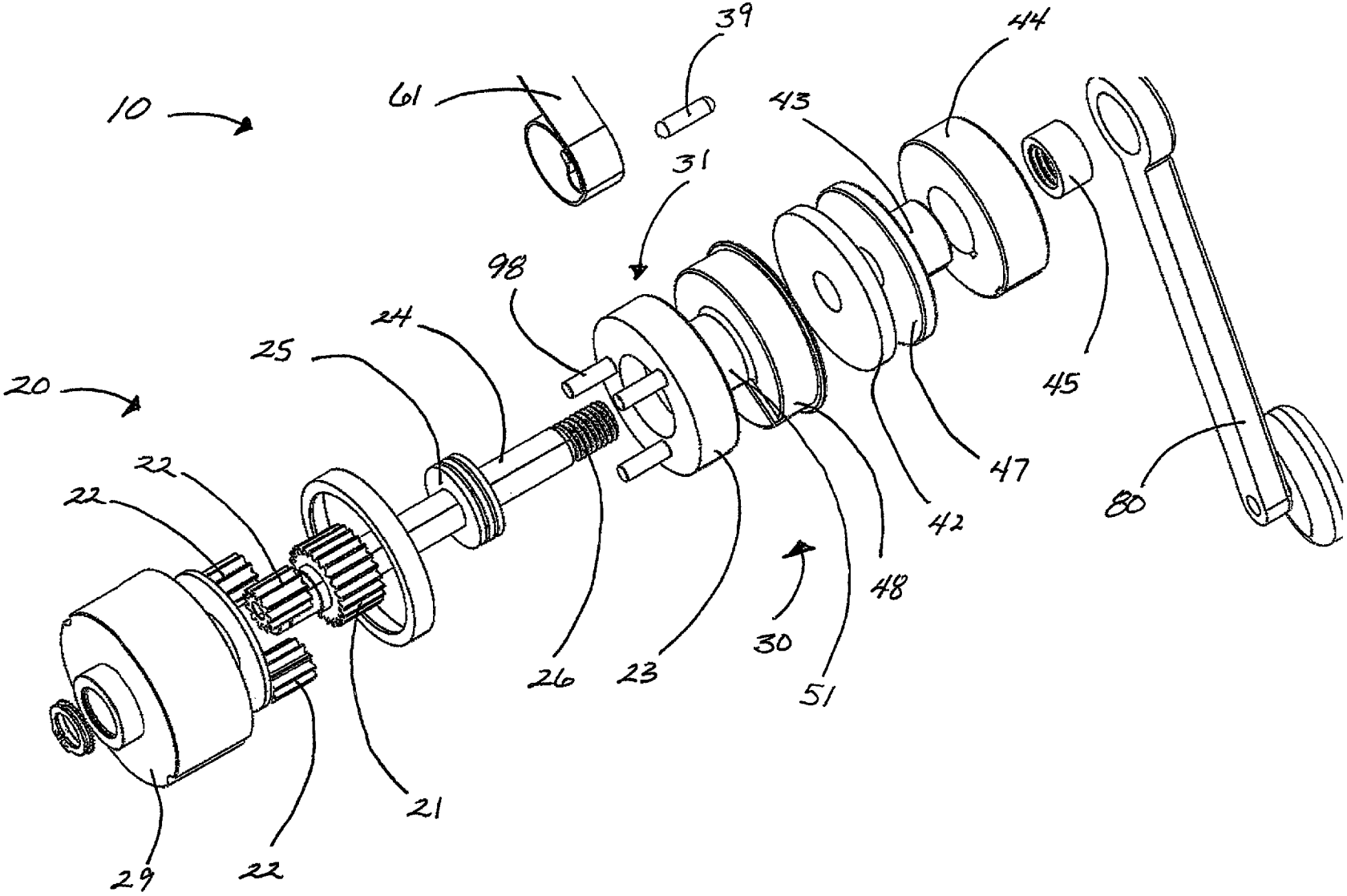
FIG. 2 is an exploded perspective view of a cranking mechanism in accordance with the present invention.
Figure 2A:
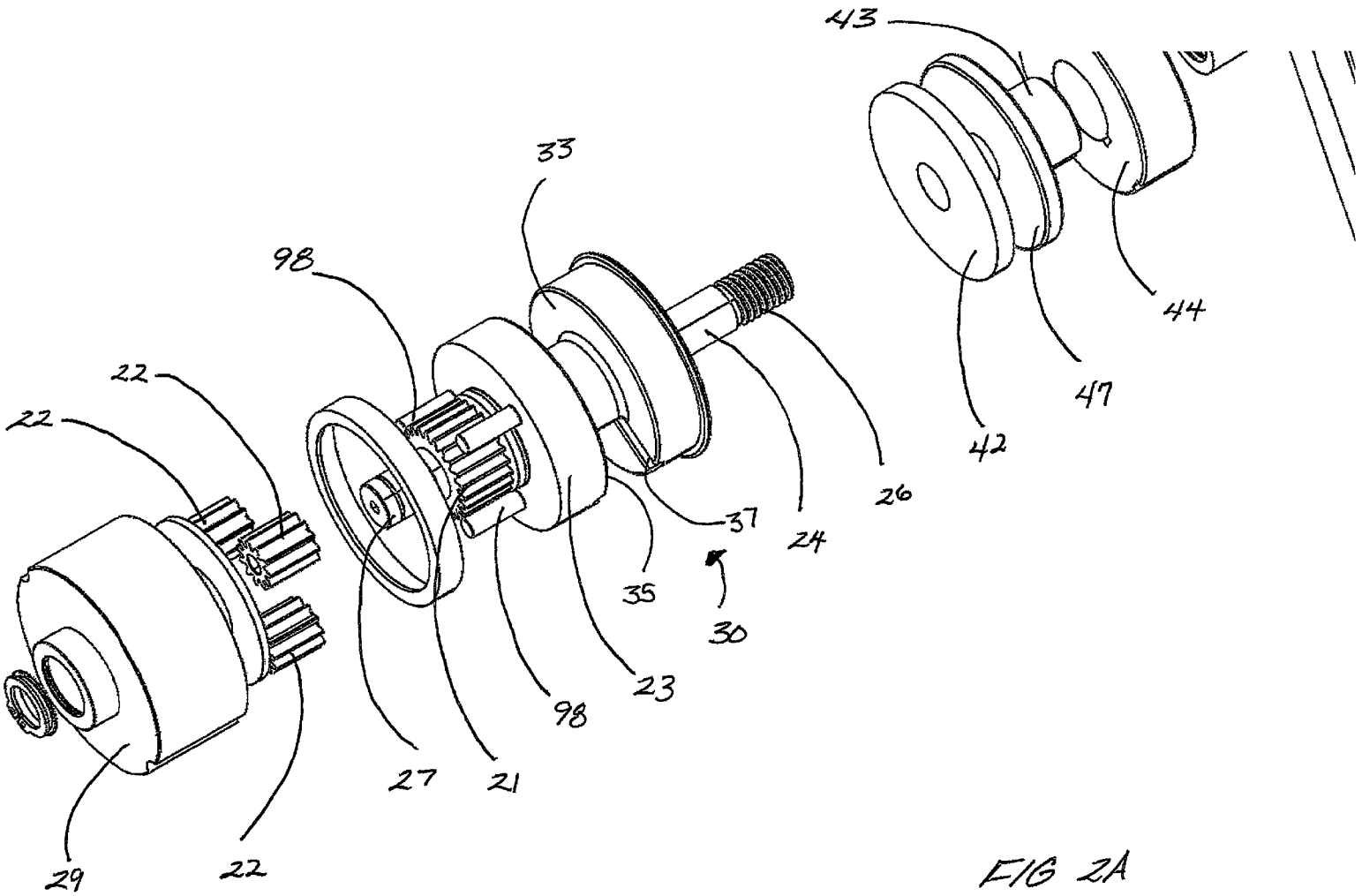
FIG. 2A is a partial exploded perspective view of a cranking mechanism in accordance with the present invention.
Figure 2B:
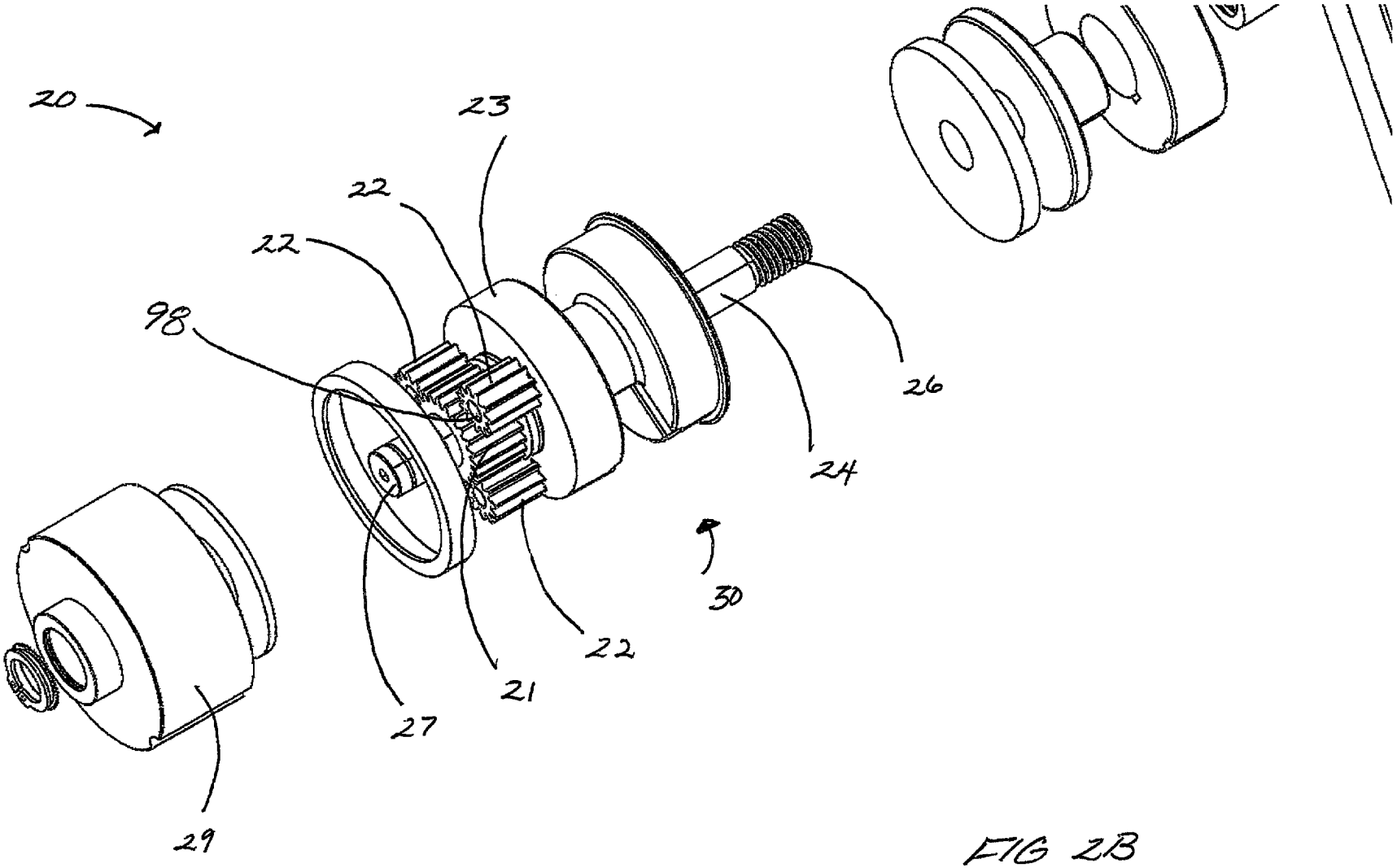
FIG. 2B is partially exploded perspective view illustrating planet gears rotatably retained on a carrier of a cranking mechanism in accordance with the present invention.
Figure 2C:
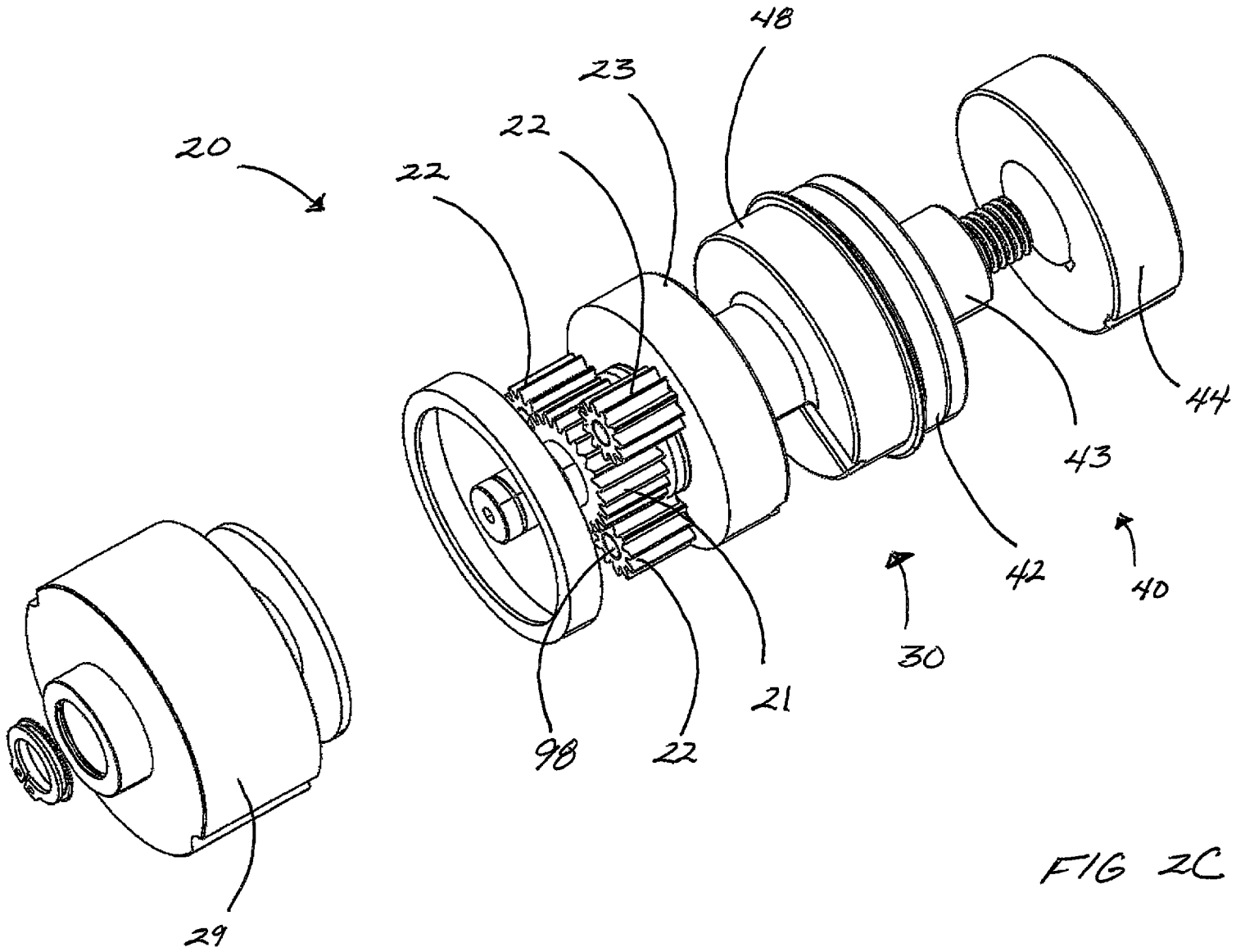
FIG. 2C is a partially exploded view with a drive unit retained on a drive shaft of a cranking mechanism in accordance with the present invention.
Figure 3:
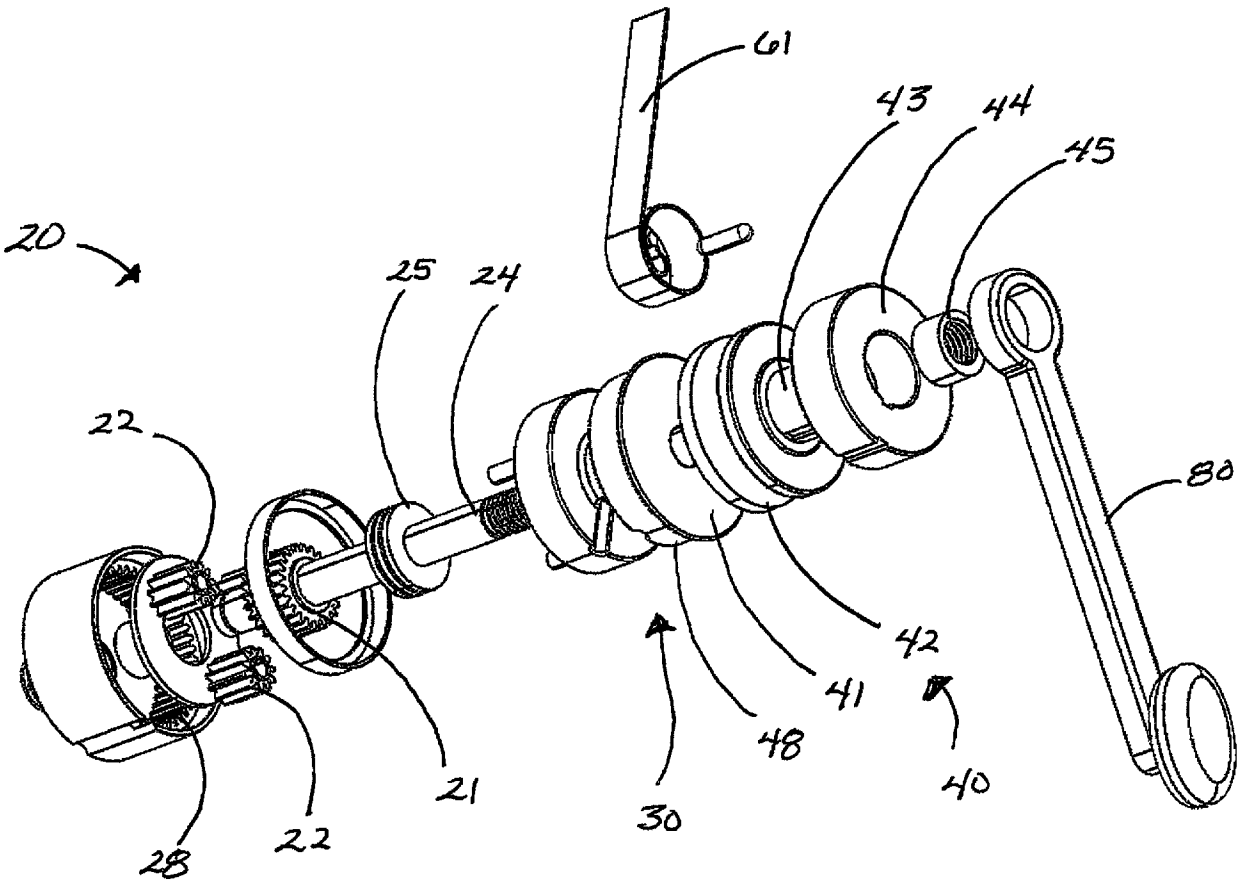
FIG. 3 is an exploded perspective view of a cranking mechanism in accordance with the present invention.
Figure 3A:
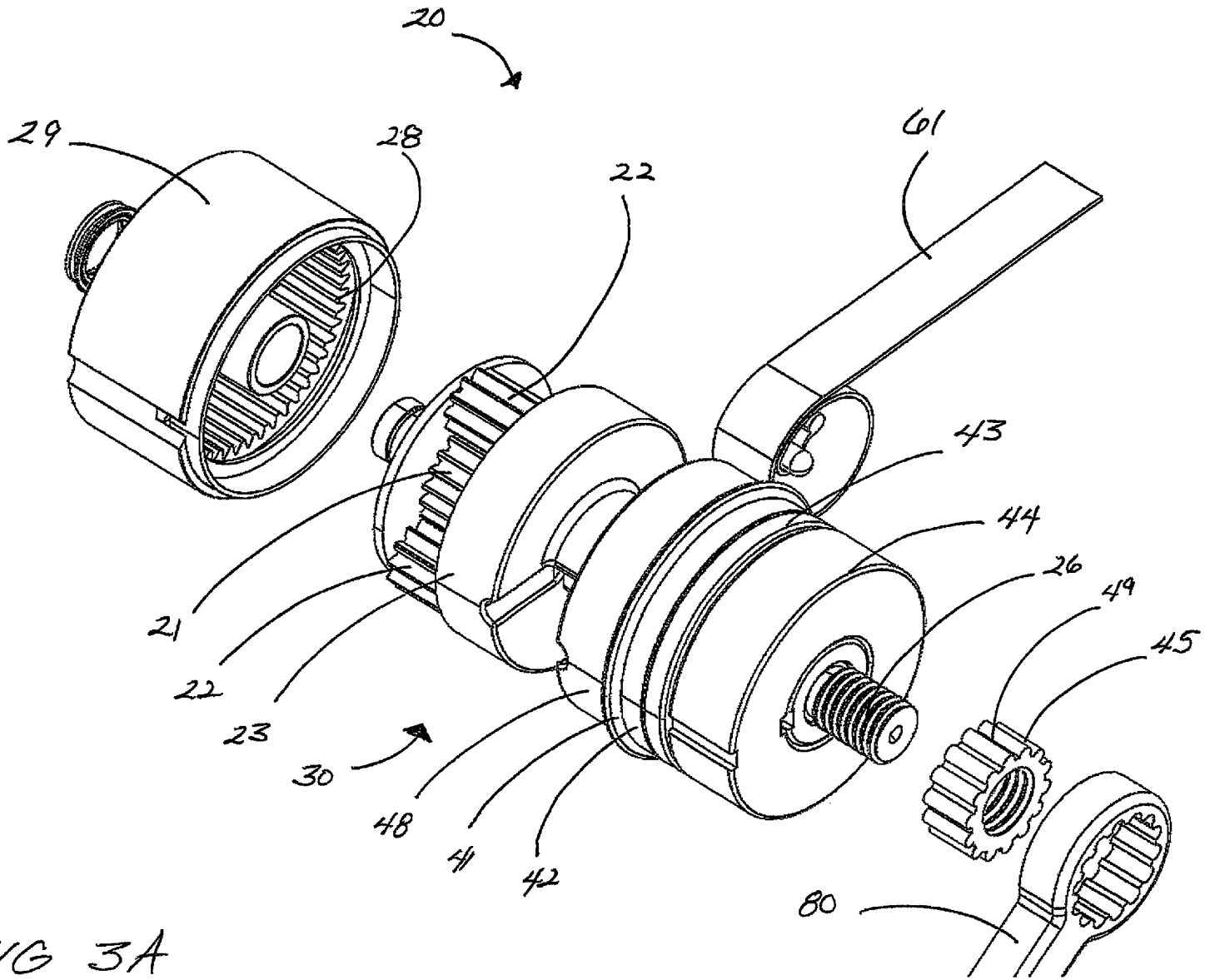
FIG. 3A is partially exploded view of a cranking mechanism in accordance with the present invention.

With reference to FIGS. 2-4, the cranking mechanism 10 preferably includes a planetary gearbox assembly 20. The planetary gearbox assembly 20 includes a sun gear 21, planet gears 22 a carrier 23, and a planetary gearbox housing 29. The drive shaft 24 is fixed axially with the sun gear 21, and axial with the drive unit 30, clutch assembly 40, and one-way bearing 44.

Figure 5:
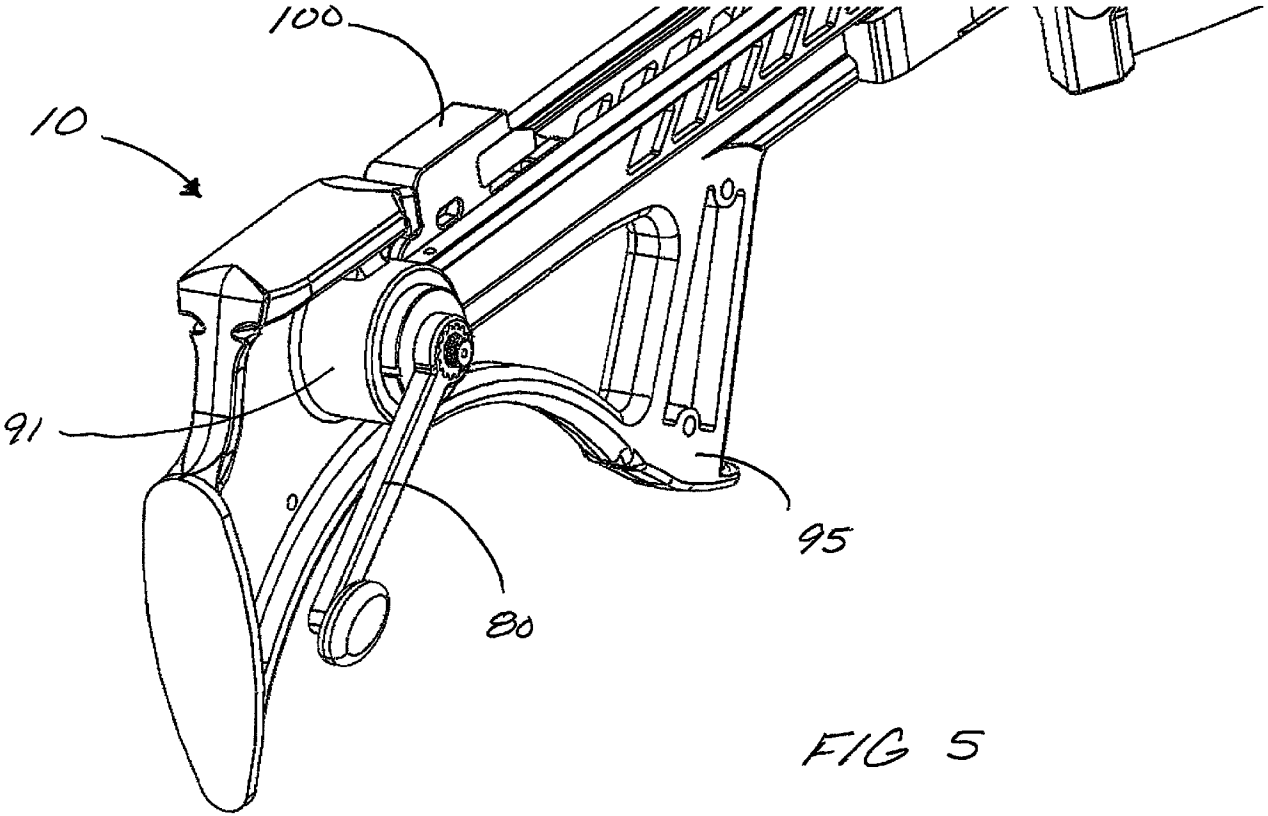
FIG. 5 is a partial perspective view of a crossbow with an integrated cranking mechanism of the present invention.
Figure 6:
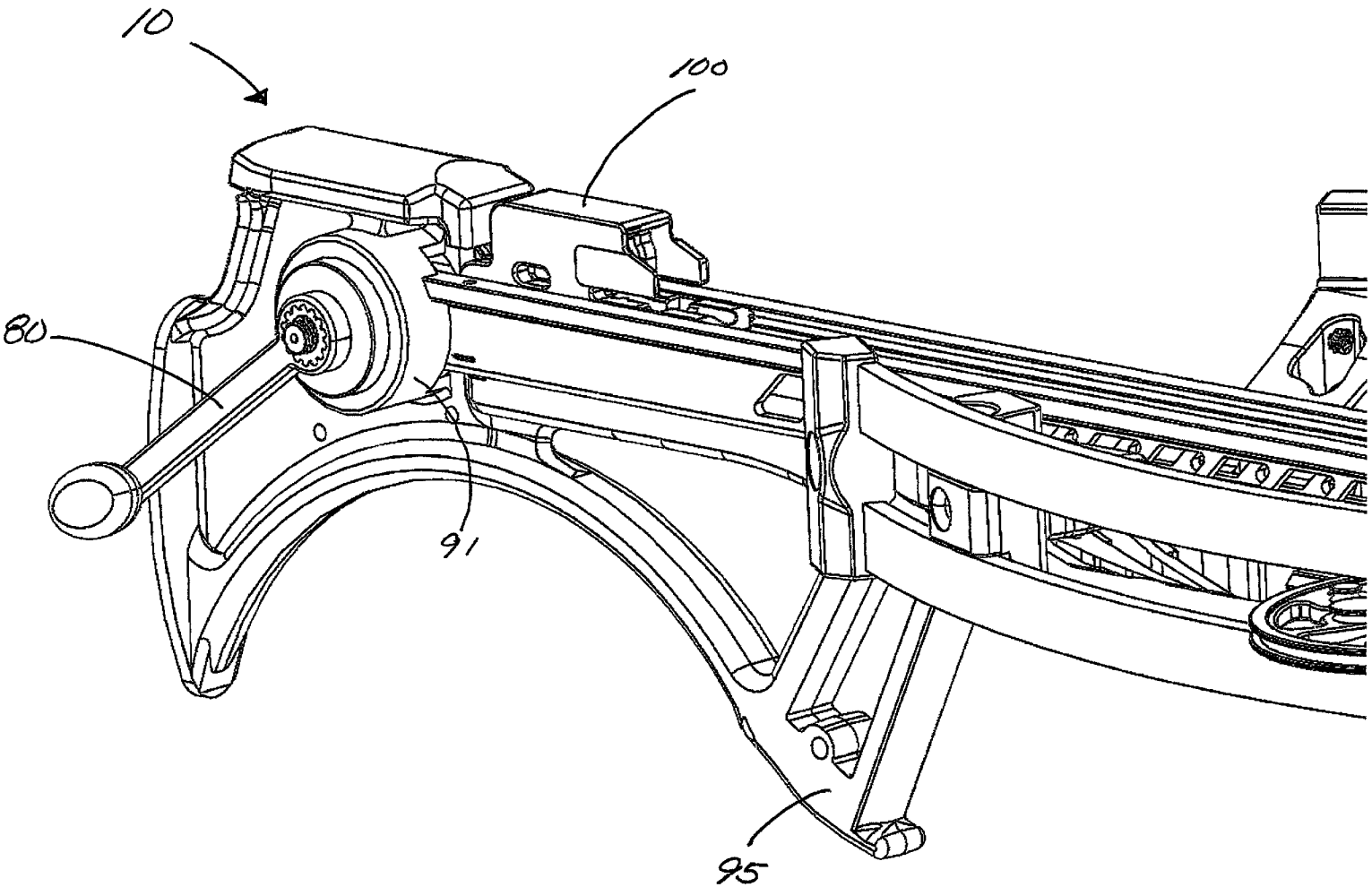
FIG. 6 is a partial perspective view of a crossbow with an integrated cranking mechanism of the present invention.

With reference to FIGS. 5-6, the cranking mechanism 10 has been integrated into the stock of a crossbow 95. An outer diameter of the one-way bearing 44 is retained in a first crank boss 91 of the crossbow stock 95 with a key 44*a* to prevent rotation of the one-way bearing 44 relative to the first cranking boss 91.

With reference to FIGS. 2*a*-3*a*, a clutch assembly 40 includes clutch pressure plate 43, at least one friction plate 42 and a drive unit 30. A first pressure surface 41 is formed on an end of the drive unit 30 and a second pressure surface 47 is formed on an end of the clutch pressure plate 43. The at least one friction plate 42 is retained between the first pressure surface 41 and the second pressure surface 47. The first pressure surface 41 may be on a flywheel 48 coupled with the drive unit 30 or integrated with a spool 31 on a first side of the drive unit 30. For the purposes of this disclosure, the flywheel 48 is the input driving force of a clutch assembly 40, and may be a separate component retained by the spool 31, or totally integrated with the drive unit 30, wherein the drive unit 30, flywheel 48 and first friction surface are preferably one component. The second pressure surface is formed on a first end the clutch pressure plate 43 or integrated with the clutch pressure plate 43. A threaded end 26 is formed on a first end of the drive shaft 24, and a pressure locking nut 45 is sized to receive the threaded end 26.

The cranking mechanism 10 utilizes a planetary gearbox assembly 20 coupled with at least one drive unit 30, and a drive shaft 24. The cranking mechanism 10 may alternately include a one-way bearing 44 to lock unwanted rotation of the drive unit 30. The cranking mechanism 10 may alternately include a one way bearing 44, a clutch assembly 40, and a planetary gearbox assembly 20 coupled with at least one drive unit 30 and with the drive shaft 24. The drive shaft 24 includes the threaded end 26 having, a length, a diameter, a friction plate journaling portion, a clutch assembly journaling portion, a drive unit journaling portion, and a second end 27 coupled with a sun gear 21. With reference to FIG. 1, a contoured opening 49 of the crank handle 80 is sized to receive a contoured outer perimeter of the pressure locking nut 45, such that the pressure lock nut 45 does not rotate relative to the crank handle 80. The threaded end 26 is threadably sized to receive the threads of the pressure locking nut 45.

Figure 5A:
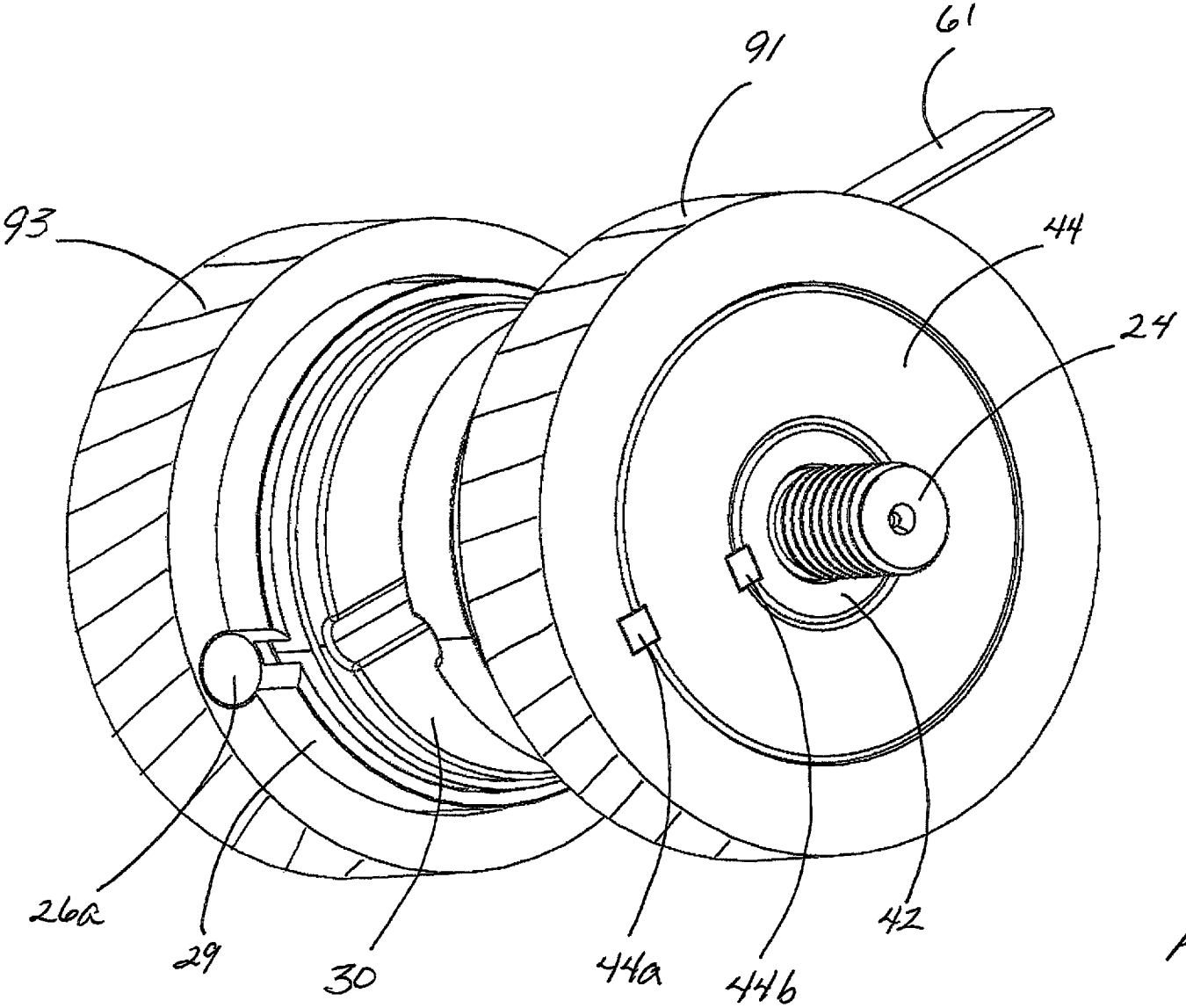
FIG. 5*a* is a partial perspective view of a crossbow with an integrated cranking mechanism retained in portions of a first cranking boss and a second crank boss of the present invention.

With reference to FIG. 5*a*, an outer diameter of the one way bearing 44 is pressed into the first cranking boss 91, and radially fixed relative to the first cranking boss 91 to prevent unwanted rotation of the one way bearing 44 with the key 44*a*. The clutch assembly 40 preferably includes a clutch pressure plate 43 radially fixed with the one way bearing 44, at least one friction plate 42, and a flywheel 48. With reference to FIG. 2, in another embodiment, a drive unit 30 includes separate components of the flywheel 48, a spool 31 and the carrier 23. The flywheel 48 includes a bore, which is sized to receive the drive shaft 24, a first pressure surface 41 is formed on a first side. The spool 31 includes a bore, which is sized to receive the drive shaft 24, a winding diameter 51 and two side walls 33, 35. The first side wall 33 of the spool 31 is engaged with a second side wall of the flywheel 48. A second side wall 35 of the spool 31 is engaged with the carrier 23.

The carrier 23 includes a second side having a plurality of journaling pins 98 extending outward from a second side and sized to receive a plurality of planet gears 22 that enable the second side of the drive unit 30 to perform as a carrier 23 for the planet gears 22. The carrier 23 including the plurality of journaling pins 98 and the spool 31 may be separate structures or they may be combined to make a single structure. The single structure would be called a spool. The drive unit 30 may be coupled with at least one radial bearing (not shown) for proper alignment with the drive shaft 24 and the plurality of planet gears 22. The spool 31 includes the two opposed side walls 33, 35. The winding diameter 51 is sized for the winding and unwinding of the elongated connecting device 61 to couple the drive unit 30 with a bowstring drawing assembly 100 such as a trigger housing, hooks, a sled, or other means known in the art designed to pull a bow string. A pair grooves 37 are formed in the two opposed side walls 33, 35 to receive an anti-rotation pin 39. The anti-rotation pin 39 is retained in an end of the elongated connecting device 61.

The drive shaft second end 27 is axially coupled with a sun gear 21, which is driven by the crank handle 80. Axial to the drive shaft 24 is a thrust bearing 25, which is located between the sun gear 21 and the second side of the carrier 23. The drive unit 30 is axial to the drive shaft 24, and rotates about the drive shaft 24. The ring gear 28 of the planetary gearbox assembly 20 is stationary relative to the stock 95 and is radial to the drive shaft 24.

We will describe three preferred embodiments: First, a cocking assembly with a planetary gear assembly 20 coupled with the drive unit 31 and the elongated connecting device 61. Second, the planetary gear assembly 20 coupled with the drive unit 30, the elongated connecting device 61, and the one-way bearing 44. Third, the planetary gear assembly 20 coupled with the drive unit 30, the elongated connecting device 61, the one-way bearing 44 and the clutch assembly 40.

When the first preferred embodiment is in use, we describe Operation 1 and Operation 2. Operation one will be the rotation of the drive shaft 24 in a first direction. Operation 2 will be the rotation of the drive shaft 24 in a second direction.

Operation 1: The bowstring-drawing assembly 100 is engaged with a bowstring when the bowstring is in the un-cocked or at-rest position. As the crank handle 80 is rotated in a first direction, the drive shaft 24 is rotated in the first direction, causing rotation of the sun gear 21 the first direction, which in turn causes rotation of the planet gears 22, rotating the drive unit 30 to wind the elongated connecting device 61 on the winding diameter 51.

Stored energy in the bow limbs of the crossbow bias the elongated connecting device 61 to pay out, or pull away from the drive unit 30, the drive unit 30 and the planetary gear assembly 20 bias the drive shaft 24 to rotate in a second direction, however due to the anti-reverse lever 97, the elongated connecting device 61 will not pay out.

After disengagement of the anti-reverse lever 97, the crank handle 80 is rotated in a second direction, the drive shaft 24 is rotated in a second direction, causing rotation of the sun gear 21 in a second direction, which in turn causes rotation of the planet gears 22, rotating the drive unit 30 to un-wind the elongated connecting device 61 from the drive unit 30.

Stored energy in the bow limbs of the crossbow bias the elongated connecting device 61 to pay out, or pull away from the drive unit 30, the drive unit 30 and the planetary gear assembly 20 bias the drive shaft 24 to rotate in the second direction. Due to the disengagement of anti-reverse lever 97, the elongated connecting device 61 will pay out.

When the second preferred embodiment is in use, we describe Operation 1 and Operation 2. Operation one will be the rotation of the drive shaft 24 in the first direction. Operation 2 will be the rotation of the drive shaft 24 in the second direction.

Operation 1: The bowstring-drawing assembly 100 is engaged with a bowstring when the bowstring is in the un-cocked or at-rest position. As the crank handle 80 is rotated in the first direction, the drive shaft 24 is rotated in the first direction, causing rotation of the sun gear 21 in the first direction, which in turn causes rotation of the planet gears 22. The sun gear 21 turns the planet gears 22, the planet gears 22 turn the carrier 23 to wind the elongated connecting device 61 on the winding diameter 51.

Stored energy in the bow limbs of the crossbow bias the elongated connecting device 61 to pay out, or pull away from the drive unit 30. The drive unit 30 and the planetary gear assembly 20 bias the drive shaft 24 to lock direction of the one-way bearing 44, that when the crank handle 80 is not rotated, the stored energy forces the drive unit 30 in the direction of pay-out, however the one-way bearing 44 prevents the elongated connecting device 61 from paying out.

After disengaging the one-way bearing 44, the crank handle 80 is rotated in a second direction, the drive shaft 24 is rotated in the second direction, causing rotation of the sun gear 21 the second direction, which in turn causes rotation of the planet gears 22. The sun gear 21 turns the planet gears 22, the planet gears 22 then turn the carrier 23 to unwind the elongated connecting device 61 from the drive unit 30.

When the third preferred embodiment is in use, we describe Operation 1 and Operation 2. Operation one will be the rotation of the drive shaft 24 in a first direction. Operation 2 will be the rotation of the drive shaft 24 in a second direction.

Operation 1: The bowstring-drawing assembly 100 is engaged with a bowstring when the bowstring is in the un-cocked or at-rest position. As the crank handle 80 is rotated in a first direction, a pressure locking nut 45 is tightened to the pressure plate 43, drawing the drive shaft 24 and all associated parts with it towards the locking pressure nut 45, where the frictional forces occur between the first and second pressure surfaces 41 and 47 on the friction plate 42. The drive shaft 24 is rotated in the first direction, causing rotation of the sun gear 21 in the first direction, which in turn causes rotation of the planet gears 22, rotating the first friction surface 41 in an opposite direction of the second friction surface 47. Frictional forces cause the clutch assembly 40 to "seize", due to the first pressure surface 41 rotating an opposite direction of the second pressure surface 47, tightening on the friction plate 42. The sun gear 21 turns the planet gears 22, the planet gears 22 then turn the carrier 23 to wind the elongated connecting device 61 on the winding diameter 51.

Stored energy in the bow limbs of the crossbow bias the elongated connecting device 61 to pay out, or pull away from the drive unit 30, the drive unit 30 and the planetary gear assembly 20 bias the drive shaft 24 and clutch assembly 40 to the lock a direction of the one-way bearing 44 and the pressure locking nut 45, such that when the crank handle 80 is not rotated, the stored energy forces in the drive unit 30, because the clutch assembly 20 has become seized to prevent rotation of the drive unit 30 which prevents pay out of the elongated connecting device 61.

Operation 2: Rotation of the crank handle 80 in a second direction, loosens the pressure locking nut 45 from the pressure plate 43, and the stored energy causes the rotation of the drive unit 30 in the first direction, creating counter-rotational forces throughout the assembly and de-compressing the friction surfaces 41 and 47 on the friction plate 42, wherein the drive unit 30 is allowed to rotate and pays out the elongated connecting device 61 until the crank handle 80 is no longer rotated in the second direction. The rotation of the crank handle 80 allows slippage of the clutch assembly 40 just enough as to allow the drive unit 30 to pay out the elongated connecting device 61. As soon as the crank handle 80 stops rotating, the stored energy continues to bias the elongated connecting device 61 to force the drive unit 30 and all associated components to rotate against the one-way bearing 44 and the pressure locking nut 45, automatically tightening the pressure locking nut 45 against the pressure plate 43, seizing the clutch assembly 40, thus preventing unwanted rotation of the drive unit 30.

The added feature of the cranking mechanism 10 being integrated with the stock and or frame allows for a more compact, easier to manufacture crossbow cranking device. Further, the use of at least one drive unit 30 coupled to an elongated connecting device 61 simplifies design, uses fewer parts, and is easier to manufacture. The present invention may be utilized with or without the clutch assembly 40 to control rotation of the drive unit 30.

Accordingly, it is an object of the present invention to provide a cranking mechanism, which utilizes a planetary gear set coupled with a drive unit to cock a crossbow. A one-way bearing may be integrated to lock unwanted rotation of a drive unit. It is an object of the invention to provide a cranking mechanism incorporated with the stock and or frame, which provides at least one drive unit coupled to an elongated connecting device to cock a crossbow.

These and additional objects, advantages, features and benefits of the present invention will become apparent from the following specification.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A cranking mechanism for a crossbow comprising:

a planetary gear set includes a sun gear, a plurality of planet gears and a ring gear, said ring gear is stationary and concentric relative to said sun gear;

a drive shaft includes a first driven end and a second drive end, a sun gear is retained on said second drive end;

a spool includes a plurality of pins extending from one side thereof to rotatably retain said plurality of planet gears, said sun gear causes rotation of said plurality of planet gears, said plurality of planet gears also engage said ring gear, wherein rotation of said plurality of planet gears causes rotation of said spool and an elongated connecting device includes a spool end, said spool end is fixed to a winding diameter of said spool, wherein rotation of said drive shaft winds said elongated connecting device on said winding diameter;

wherein said cranking mechanism for the crossbow is one of an integral portion of the crossbow and removable from the crossbow.

2. The cranking mechanism for a crossbow of claim 1, further comprising:

a bowstring drawing device is connected to an end opposite said spool end, said bowstring drawing device is one of a sled, a hook, a trigger box, and a latch assembly.

3. The cranking mechanism for a crossbow of claim 1, further comprising:

a tension nut is threaded on to said first driven end of said drive shaft; and a handle includes a cavity to receive said tension nut, said tension nut does not rotate relative to said handle.

4. The cranking mechanism for a crossbow of claim 1, further comprising:

a handle is retained on said first driven end of said drive shaft, said handle does not rotate relative to said drive shaft.

5. The cranking mechanism for a crossbow of claim 1, further comprising:

a ratchet gear is retained on said drive shaft, such that it does rotate relative to said drive shaft; and an anti-rotation lever engages said ratchet gear such that said drive shaft rotates in only one direction, said anti-rotation lever is disengaged from said ratchet gear to allow rotation of said drive in both directions.

6. A cranking mechanism for a crossbow comprising:

a planetary gear set includes a sun gear, a plurality of planet gears and a ring gear, said ring gear is stationary and concentric relative to said sun gear;

a drive shaft includes a first driven end and a second drive end, a sun gear is retained on said second drive end;

a spool includes a plurality of pins extending from one side thereof to rotatably retain said plurality of planet gears, said sun gear causes rotation of said plurality of planet gears, said plurality of planet gears also engage said ring gear, wherein rotation of said plurality of planet gears causes rotation of said spool;

an elongated connecting device includes a spool end, said spool end is fixed to a winding diameter of said spool, wherein rotation of said drive shaft winds said elongated connecting device on said winding diameter;

a one-way rotation device only allows said drive shaft to be rotated in one direction unless said one-way rotation device is released; and wherein said cranking mechanism for the crossbow is one of an integral portion of the crossbow and removable from the crossbow.

7. The cranking mechanism for a crossbow of claim 6, further comprising:

a bowstring drawing device is connected to an end opposite said spool end, said bowstring drawing device is one of a sled, a hook, a trigger box, and a latch assembly.

8. The cranking mechanism for a crossbow of claim 6, further comprising:

a tension nut is threaded on to said first driven end of said drive shaft; and a handle includes a cavity to receive said tension nut, said tension nut does not rotate relative to said handle.

9. The cranking mechanism for a crossbow of claim 6, further comprising:

a handle is retained on said first driven end of said drive shaft, said handle does not rotate relative to said drive shaft.

10. The cranking mechanism for a crossbow of claim 6, further comprising:

a ratchet gear is retained on said drive shaft, such that it does rotate relative to said drive shaft; and an anti-rotation lever engages said ratchet gear such that said drive shaft rotates in only one direction, said anti-rotation lever is disengaged from said ratchet gear to allow rotation of said drive in both directions.

11. A cranking mechanism for a crossbow comprising:

a planetary gear set includes a sun gear, a plurality of planet gears and a ring gear, said ring gear is stationary and concentric relative to said sun gear;

a drive shaft includes a first driven end and a second drive end, a sun gear is retained on said second drive end;

a spool includes a plurality of pins extending from one side thereof to rotatably retain said plurality of planet gears, said sun gear causes rotation of said plurality of planet gears, said plurality of planet gears also engage said ring gear, wherein rotation of said plurality of planet gears causes rotation of said spool;

an elongated connecting device includes a spool end and a string end, said spool end is fixed to a winding diameter of said spool, wherein said string end is coupled to a string of the crossbow;

a clutch is retained on said drive shaft;

a one-way bearing rotation device is engaged with said clutch, axial tension is applied to said one-way bearing and said clutch in a first direction through said driven end to wind said elongated connecting device on said spool; and wherein said cranking mechanism for the crossbow is one of an integral portion of the crossbow and removable from the crossbow.

12. The cranking mechanism for a crossbow of claim 11, further comprising:

a bowstring drawing device is connected to an end opposite said spool end, said bowstring drawing device is one of a sled, a hook, a trigger box, and a latch assembly.

13. The cranking mechanism for a crossbow of claim 11, further comprising:

a tension nut is threaded on to said first driven end of said drive shaft; and a handle includes a cavity to receive said tension nut, said tension nut does not rotate relative to said handle.

14. The cranking mechanism for a crossbow of claim 11 wherein:

said clutch includes a pressure plate and a friction plate, said pressure plate is engaged with said one-way bearing, said friction plate makes contact with said pressure plate and said spool.

15. The cranking mechanism for a crossbow of claim 11 wherein:

said driven end is rotated in a second direction to disengage said clutch to allow said elongated connecting device to be unwound from said spool, wherein rotation in said first direction re-engages said clutch and prevents unwinding of said elongated connecting device.

* * * * *